US009434568B2

(12) United States Patent
Osaki et al.

(10) Patent No.: US 9,434,568 B2
(45) Date of Patent: Sep. 6, 2016

(54) IMAGE FORMING APPARATUS THAT PREVENTS DAMAGE OF MULTI-TRAY COVER AND RELAY DEVICE COVER

(71) Applicant: KYOCERA Document Solutions Inc., Osaka (JP)

(72) Inventors: Shuji Osaki, Osaka (JP); Hiroshi Inui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/001,911

(22) Filed: Jan. 20, 2016

(65) Prior Publication Data

US 2016/0214823 A1 Jul. 28, 2016

(30) Foreign Application Priority Data

Jan. 22, 2015 (JP) ..... 2015-010403

(51) Int. Cl.
*B65H 29/00* (2006.01)
*B65H 31/24* (2006.01)

(52) U.S. Cl.
CPC ..... *B65H 31/24* (2013.01); *B65H 2402/441* (2013.01); *B65H 2402/45* (2013.01)

(58) Field of Classification Search
CPC ..... B65H 31/24; B65H 2402/441; B65H 2402/45
See application file for complete search history.

(56) References Cited

U.S. PATENT DOCUMENTS

| | | | | |
|---|---|---|---|---|
| 7,976,021 | B2 | 7/2011 | Matsuo | 271/305 |
| 9,056,743 | B2 * | 6/2015 | Sato | B65H 29/125 |
| 2009/0283962 | A1 * | 11/2009 | Spence | B65H 29/125 271/225 |
| 2013/0334759 | A1 * | 12/2013 | Osaki | B65H 29/00 271/3.14 |
| 2014/0151955 | A1 * | 6/2014 | Yoshida | B65H 29/125 271/184 |
| 2015/0298931 | A1 * | 10/2015 | Osaki | B65H 43/00 271/265.01 |

FOREIGN PATENT DOCUMENTS

JP 5433177 B2 3/2014

* cited by examiner

*Primary Examiner* — Howard Sanders
(74) *Attorney, Agent, or Firm* — Stein IP, LLC

(57) ABSTRACT

An image forming apparatus includes a multi-tray device and a relay device. The relay device includes a relay device cover that openably and closably covers a top side of the relay device. One of an edge portion at a side of the relay device in a lower end portion of the multi-tray cover and an edge portion at a side of the multi-tray device in a top surface portion of the relay device cover includes an inclined surface portion forming a shape by chamfering the edge portion. The inclined surface portion is formed so as to produce a component force in a direction to close the multi-tray cover when the top surface portion of the relay device cover bumps against the lower end portion of the multi-tray cover, while the relay device cover opens in a state where the multi-tray cover is opened.

4 Claims, 7 Drawing Sheets

Lateral Direction of Image Forming Apparatus

Left Side ⟷ Right Side

Lateral Direction of Image Forming Apparatus

Left Side ⟷ Right Side

IMAGE FORMING APPARATUS THAT PREVENTS DAMAGE OF MULTI-TRAY COVER AND RELAY DEVICE COVER

INCORPORATION BY REFERENCE

This application is based upon, and claims the benefit of priority from, corresponding Japanese Patent Application No. 2015-010403 filed in the Japan Patent Office on Jan. 22, 2015, the entire contents of which are incorporated herein by reference.

BACKGROUND

Unless otherwise indicated herein, the description in this section is not prior art to the claims in this application and is not admitted to be prior art by inclusion in this section.

There is known an image forming apparatus including a multi-tray device that sorts paper sheets discharged from an image forming apparatus body. The multi-tray device includes a plurality of sheet discharge trays any of which a user may select, a sheet discharge conveyance path that extends in a vertical direction and connects to a base end portion of each of the sheet discharge trays, and a housing portion that internally houses the sheet discharge conveyance path and is mounted on a side surface of the image forming apparatus body. A switch mechanism, which switches a conveyance destination of the paper sheet between the sheet discharge conveyance path and the sheet discharge tray, is mainly housed in the housing portion. An opening and closing cover is mounted on a surface of the image forming apparatus body side in the housing portion. The opening and closing cover turns around an axis extending in the vertical direction as a pivot so as to be openable and closable. The user opens the opening and closing cover to perform a jam process in the sheet discharge conveyance path or similar operation.

A sheet discharge tray portion may be formed over the image forming apparatus body as the above-described image forming apparatus. In this case, a relay device is employed for conveying the paper sheet formed in the image forming apparatus body to the multi-tray device. The relay device is detachably placed on the above-described sheet discharge tray portion. The relay device includes a relay conveyance path that horizontally extends from a sheet discharge exit of the image forming apparatus body to be connected to a sheet feed opening of the multi-tray device, and the housing portion that internally houses this relay conveyance path. An upper side of the housing portion is covered with the opening and closing cover that turns around in the vertical direction using a back end portion as a fulcrum. The user lifts a front end portion of the opening and closing cover to turn it upward, so as to perform the jam process in the relay device.

SUMMARY

An image forming apparatus according to one aspect of the disclosure includes an image forming apparatus body, a multi-tray device, and a relay device. The multi-tray device includes a plurality of sheet discharge trays located in a vertical direction. The multi-tray device is mounted on a side surface of the image forming apparatus body. The relay device is disposed over the image forming apparatus body and conveys a paper sheet discharged from the image forming apparatus body to the multi-tray device. The multi-tray device includes a multi-tray cover that turns around an axis extending in the vertical direction as a pivot to openably and closably cover a side of the relay device of the multi-tray device. The relay device includes a relay device cover that turns around an axis extending in a horizontal direction as the pivot to openably and closably cover a top side of the relay device. One of an edge portion at a side of the relay device in a lower end portion of the multi-tray cover and an edge portion at a side of the multi-tray device in a top surface portion of the relay device cover includes an inclined surface portion forming a shape by chamfering the edge portion. The inclined surface portion is formed so as to produce a component force in a direction to close the multi-tray cover when the top surface portion of the relay device cover bumps against the lower end portion of the multi-tray cover, while the relay device cover opens in a state where the multi-tray cover is opened.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
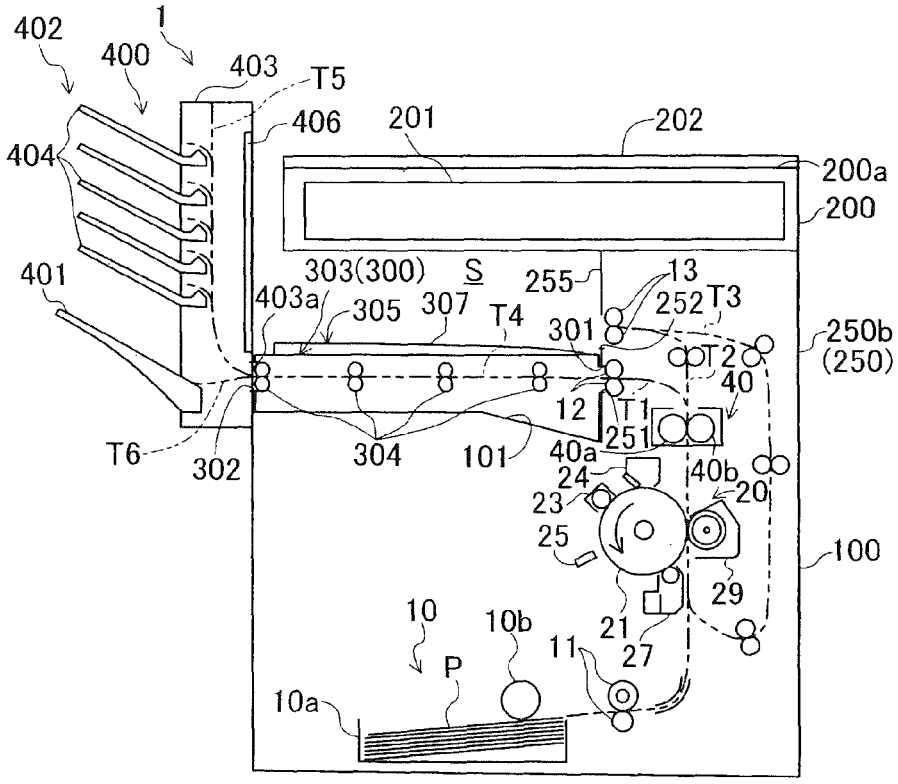
FIG. 1 schematically illustrates an internal structure of an image forming apparatus according to Embodiment 1.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Hereafter, a detailed description will be given of embodiments of the disclosure with reference to the drawings. The disclosure will not be limited to the embodiments described below.

Embodiment 1

FIG. 1 illustrates a digital copying machine as an example of an image forming apparatus 1 according to the embodiment. In the following description, unless otherwise defined, the terms "front side" and "back side" refer to a front side and a back side of the image forming apparatus 1, respectively. The terms "left side" and "right side" refer to the left side and the right side viewed from the front side of the image forming apparatus 1.

The above-described image forming apparatus 1, which is a so-called copier of an in-barrel sheet discharge type, includes an image forming apparatus body 100, a scanner housing portion 200, and a connection chassis portion 250. The scanner housing portion 200 is arranged above the image forming apparatus body 100. The image forming apparatus body 100 and the scanner housing portion 200 are connected via the connection chassis portion 250. An in-barrel sheet discharge space S is formed between the image forming apparatus body 100 and the scanner housing portion 200. The connection chassis portion 250 includes a back-side connection chassis portion 250*a* (see FIG. 4) connected to a back end portion of the image forming apparatus body 100, and a right-side connection chassis portion 250*b* connected to a right side end portion of the image forming apparatus body 100. A first sheet discharge exit 251 and a second sheet discharge exit 252 are vertically aligned to be formed in a standing wall portion 255 that faces the in-barrel sheet discharge space S in the right-side connection chassis portion 250*b*. A relay device 300 is detachable in the in-barrel sheet discharge space S. The relay device 300 conveys a paper sheet P after image formation, which is discharged from the first sheet discharge exit 251, to a multi-tray device 400. The multi-tray device 400, which includes a plurality of sheet discharge trays 404, conveys the paper sheet P to the sheet discharge tray selected by a user based on a tray selection signal from the image forming apparatus body 100.

The above-described scanner housing portion 200 has a top surface 200*a* that is openably and closably covered with a document cover 202. An image reading unit 201 housed in the scanner housing portion 200 optically reads an original document placed on the top surface 200*a* of the scanner housing portion 200 to generate image data of the original document. The image data generated by the image reading unit 201 is stored in a data storage unit (not illustrated).

The above-described image forming apparatus body 100 is formed in a shape of an approximately rectangular solid. An image forming unit 20 is arranged close to the right side of an upper portion in the image forming apparatus body 100. A fixing unit 40 is located above the image forming unit 20. A paper sheet feeder 10 is located below to the left side of the image forming unit 20. The paper sheet feeder 10 includes a sheet feed cassette 10*a*, in which the paper sheets P are housed, and a pickup roller 10*b*, which extracts the paper sheets P inside the sheet feed cassette 10*a* and sends out of the cassette. The paper sheet P sent out of the cassette from the sheet feed cassette 10*a* is supplied to the image forming unit 20 via a conveyance roller pair 11.

The image forming unit 20 includes a photoreceptor drum 21, a charger 23, an exposure apparatus 25, a developing device 27, and a transfer unit 29. The image forming unit 20: firstly charges a circumference surface of the photoreceptor drum 21 with the charger 23; subsequently forms electrostatic latent image by irradiating a surface of the photoreceptor drum 21 with laser lights based on document image data, which is the image data of document image generated by the image reading unit 201, with the exposure apparatus 25; forms toner image by developing the formed electrostatic latent image with the developing device 27; and subsequently transfers the above-described toner image on the paper sheet P supplied from the paper sheet feeder 10 with the transfer unit 29 to supply the paper sheet P after transfer to the fixing unit 40. Reference numeral 24 denotes a cleaning unit for removal of the residual toner on the surface of the photoreceptor drum 21.

In the above-described fixing unit 40, applying pressure on and heat to the paper sheet P supplied by the image forming unit 20 between a fixing roller 40*a* and a pressure roller 40*b* fixes the toner image to this paper sheet P. Subsequently, the paper sheet P, to which the toner image is fixed in the fixing unit 40, is conveyed upward with both rollers 40*a* and 40*b*. A conveyance path, to which the paper sheet P is conveyed, is split into a first conveyance path T1 and a second conveyance path T2 above the fixing unit 40. The paper sheet sent out by both rollers 40*a* and 40*b* is supplied to one of the first conveyance path T1 and the second conveyance path T2.

The first conveyance path T1 curves upward from the fixing unit 40 to the left side to be connected to the above-described first sheet discharge exit 251. A first discharge roller pair 12 is located in a downstream side end portion of the first sheet discharge exit 251. The second conveyance path T2 extends upward from the fixing unit 40, and then bends to the left side to be connected to the above-described second sheet discharge exit 252. A second discharge roller pair 13 is located in the downstream side end portion of the second sheet discharge exit 252. A conveyance path for duplex printing T3, which reversely feeds this paper sheet P during duplex printing so as to supply to the image forming unit 20 again, is additionally connected to the above-described second conveyance path T2.

While the relay device 300 is not mounted on the in-barrel sheet discharge space S, a paper sheet tray 101 receives the paper sheet P discharged from the first sheet discharge exit 251. The second sheet discharge exit 252 is employed for reversely conveying a paper sheet or similar operation. On the other hand, while the relay device 300 is mounted on the in-barrel sheet discharge space S (a state as illustrated in FIG. 1), the paper sheet P after the image formation, which is discharged from the first sheet discharge exit 251, is supplied to a relay conveyance path T4 in the relay device 300.

The relay device 300 is mounted above the paper sheet tray 101 as a bottom wall portion of the in-barrel sheet discharge space S. The relay device 300 includes a body case portion 303 formed in the shape of an approximately rectangular solid in a whole view. The body case portion 303 has a right sidewall that forms a sheet feed opening 301 communicating with the first sheet discharge exit 251, and a left sidewall that forms a sheet discharge exit 302 communicating with a sheet feed opening 403*a* of the multi-tray device 400. The above-described relay conveyance path T4 is located in the relay device 300. The relay conveyance path T4, which includes four conveyance roller pairs 304, approximately horizontally extends from the sheet feed opening 301 toward the sheet discharge exit 302.

Figure 2:
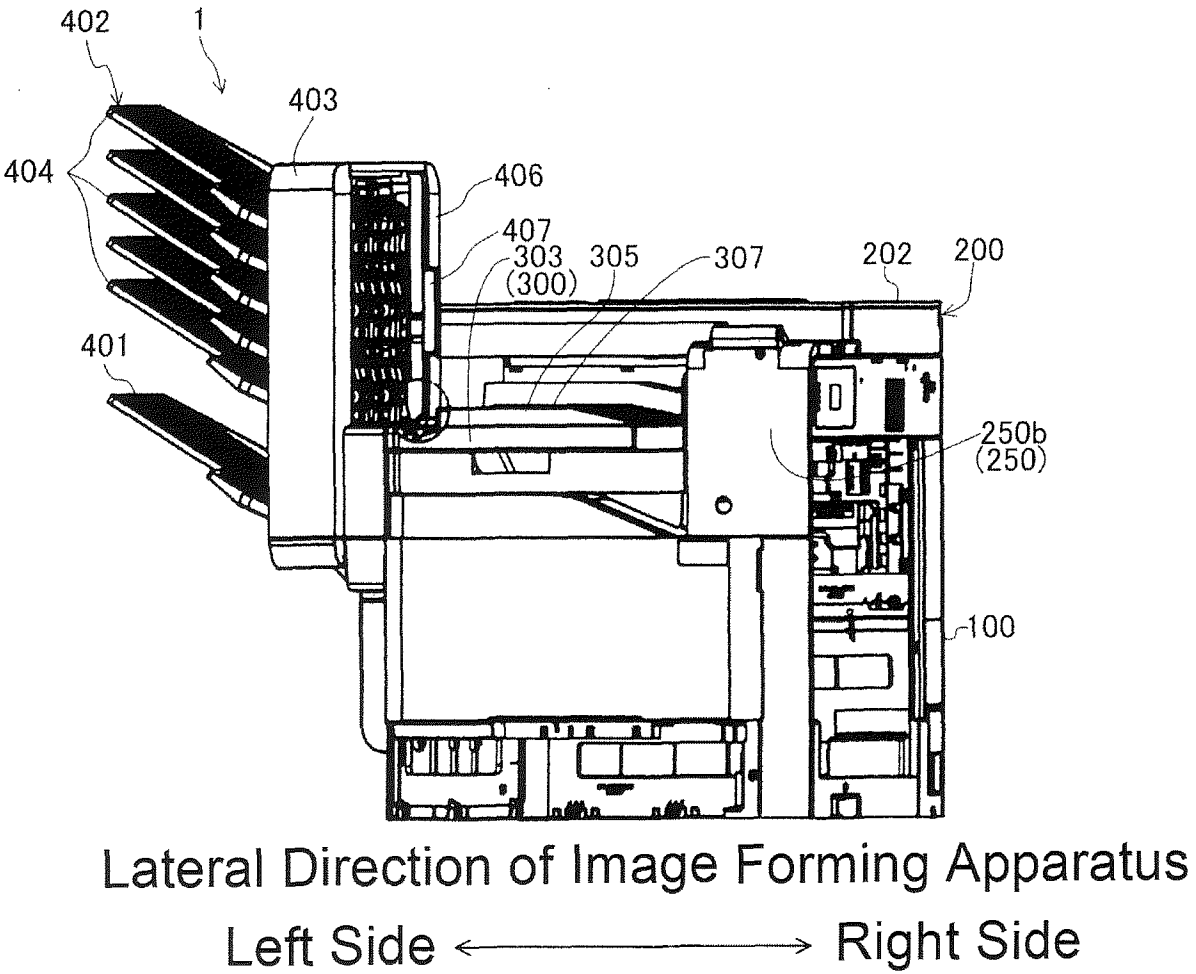
FIG. 2 illustrates the image forming apparatus where a multi-tray cover is in an open state, and a relay device cover is in a closed state according to Embodiment 1 viewed from a diagonally rightward of a front side of the apparatus.

As illustrated in FIG. 2, the body case portion 303 has a top sidewall that includes a relay device cover 305. The relay device cover 305 is formed in an approximately rectangular-box shape that opens downward. The relay device cover 305 has the top surface that forms a sheet discharge tray portion 307 which receives the paper sheet P discharged from the above-described second sheet discharge exit 252. The sheet discharge tray portion 307 has a right-side end portion that inclines downward as toward the right side. This enables the paper sheet discharged to the sheet discharge tray portion 307 to move downward along this incline to align.

Figure 3:
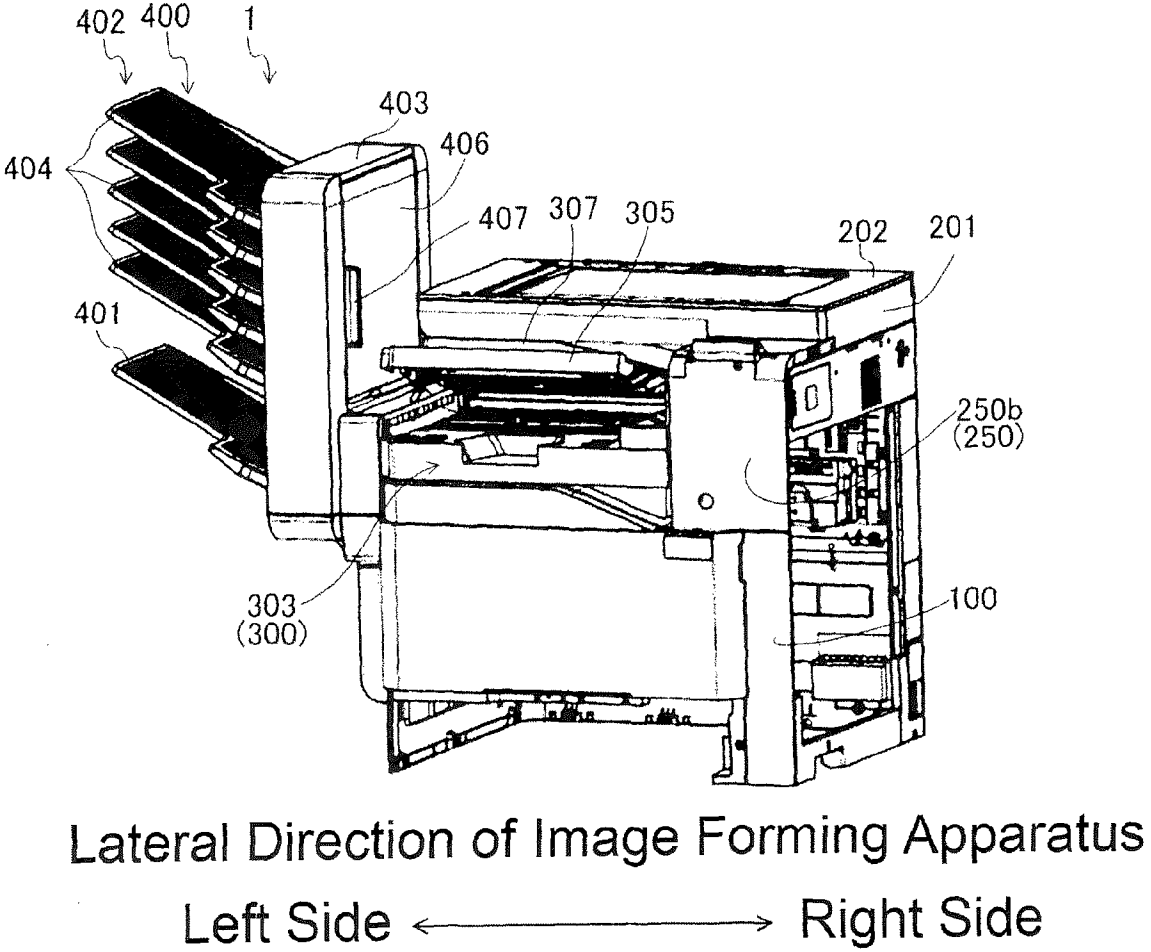
FIG. 3 illustrates the image forming apparatus where the multi-tray cover is in a closed state, and the relay device cover is in the open state according to Embodiment 1 viewed from the diagonally rightward of the front side of the apparatus.

The relay device cover 305 has both end portions in a lateral direction located in the back end portion, of which is supported by the right and left sidewalls of the body case portion 303 via a support shaft (not illustrated) extending in the lateral direction (horizontal direction). The user lifts a front end portion of the relay device cover 305 upward with his or her hand from a closed state (the state illustrated in FIG. 2). Consequently, the relay device cover 305 turns upward around the above-described support shaft (axis of the support shaft) to be in an open state (the state illustrated in FIG. 3). With the relay device cover 305 in the open state, the user can put his or her hand into the body case portion 303 to handle a paper jam or similar processing. As the user releases the hand from the relay device cover 305, the relay device cover 305 turns downward under its own weight around the above-described support shaft to return to be in the closed state (the state illustrated in FIG. 2).

The multi-tray device 400 includes a general-purpose tray portion 401, a multi-tray portion 402, and a body case portion 403. The body case portion 403 has a flat rectangular-solid shape that has a thickness in the lateral direction. The body case portion 403 has a lower end portion in the right sidewall, of which is secured to an upper end portion of a left side surface in the image forming apparatus body 100. The right sidewall of the body case portion 403 other than the lower end portion includes almost entirely a multi-tray cover 406. The multi-tray cover 406 is located above the image forming apparatus body 100 positioned at the right sidewall of the body case portion 403. The detail of the multi-tray cover 406 will be described below.

The body case portion 403 includes a vertical conveyance path T5 and an inclined conveyance path T6 (see FIG. 1). The vertical conveyance path T5 extends in the vertical direction and has the lower end portion that is connected to a downstream side end of the relay conveyance path T4. The plurality of sheet discharge trays 404 included in the multi-tray portion 402 has the base end portion that is connected to the vertical conveyance path T5. The inclined conveyance path T6 extends downward from the downstream side end of the relay conveyance path T4 to the left side to be connected to the general-purpose tray portion 401. The paper sheet discharged from the sheet discharge exit 302 of the relay device 300 is supplied to one of the vertical conveyance path T5 and the inclined conveyance path T6 with a conveyance path switching member (not illustrated). While the paper sheet supplied to the vertical conveyance path T5 is guided to the sheet discharge tray 404 selected by the user with the conveyance path switching member (not illustrated), the paper sheet supplied to the inclined conveyance path T6 is guided to the general-purpose tray portion 401.

The above-described multi-tray cover 406 is formed in a rectangular-box shape that opens toward an inner side of the body case portion 403. The multi-tray cover 406 forms a long shape in the vertical direction. The multi-tray cover 406 has both the end portions in the vertical direction located in the back end portion, of which is supported by the top and bottom sidewalls of the body case portion 403 via a support shaft 410 (see FIG. 4) extending in the vertical direction (perpendicular direction). A handle portion 407, which protrudes along the downward direction, is mounted at the central portion in the vertical direction of the front end portion of the multi-tray cover 406. By pulling the handle portion 407 to the right side from the closed state, the multi-tray cover 406 turns around in an anticlockwise direction illustrated in FIG. 5 using the above-described support shaft 410 as a fulcrum to be in the open state (the state illustrated in FIG. 4). The multi-tray cover 406 turns toward an opening side, which causes an outer surface of the multi-tray cover 406 to come in contact with a corner portion of the sheet discharge tray portion 307 when an opening angle reaches a predetermined maximum opening angle. This ensures that the opening angle of the multi-tray cover 406 is restricted to the above-described maximum opening angle or less. With the multi-tray cover 406 in the open state, the user can put his or her hand into the body case portion 403 to perform a jam process or similar operation. The handle portion 407 is pushed to the left side while the multi-tray cover 406 is in the open state, which causes the multi-tray cover 406 to turn around in a clockwise direction illustrated in FIG. 4 using the support shaft 410 as the fulcrum to eventually return to be in the closed state.

Figure 5:
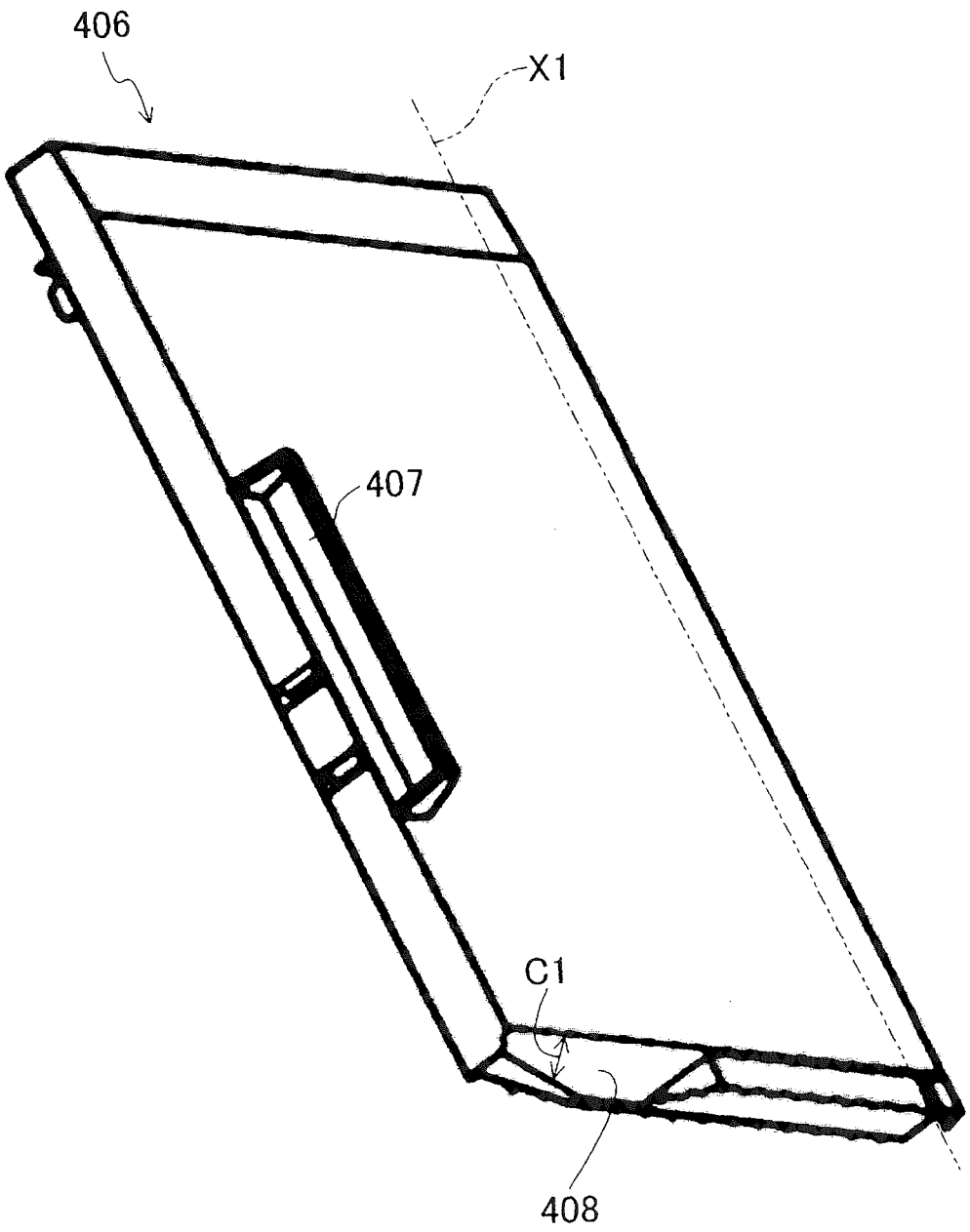
FIG. 5 diagonally illustrates the multi-tray cover according to Embodiment 1.
Figure 6:
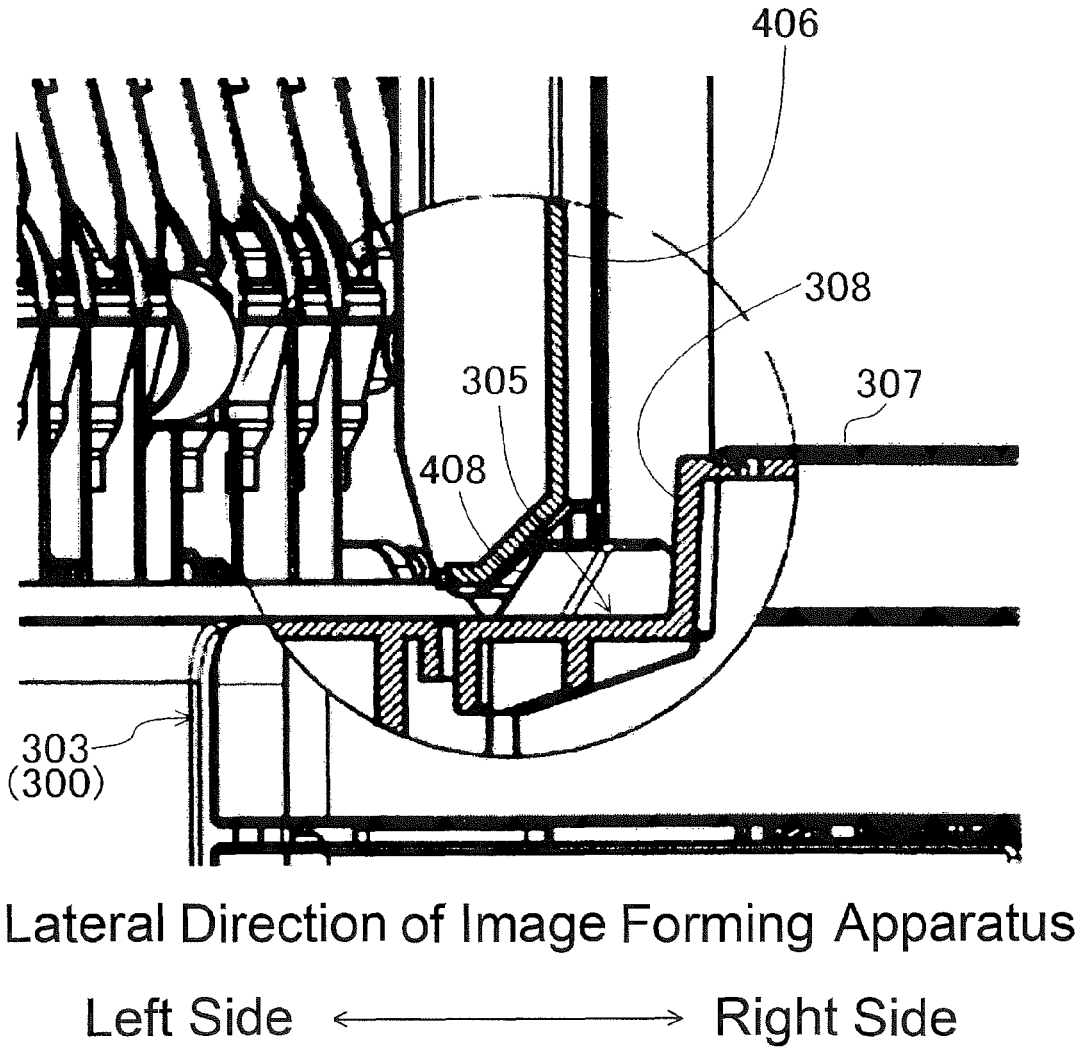
FIG. 6 illustrates an enlarged view of a periphery of a lower end portion of the multi-tray cover according to Embodiment 1.

As illustrated in FIGS. 5 and 6, the multi-tray cover 406 has the lower end portion that forms an inclined surface portion 408. The inclined surface portion 408 forms the shape, of which an edge portion of the image forming apparatus body 100 side (outer side of the body case portion 403) in the lower end portion of the multi-tray cover 406 is chamfered at an angle of about 45 degrees. In other words, the inclined surface portion 408 is angled at about 45 degrees so as to be higher as toward the right side while the multi-tray cover 406 is in the closed state. The inclined surface portion 408 has an inclination angle that remains constant along the edge portion. The inclined surface portion 408 includes a chamfer amount C1 that gradually increases from a far side toward a near side with respect to a pivotal axis X1 (axis of the support shaft 410) in the above-described edge portion. The inclined surface portion 408 is formed in only range in which this multi-tray cover 406 overlaps with the relay device cover 305, when viewed from an upper side while the multi-tray cover 406 is opened to the maximum opening angle.

Figure 4:
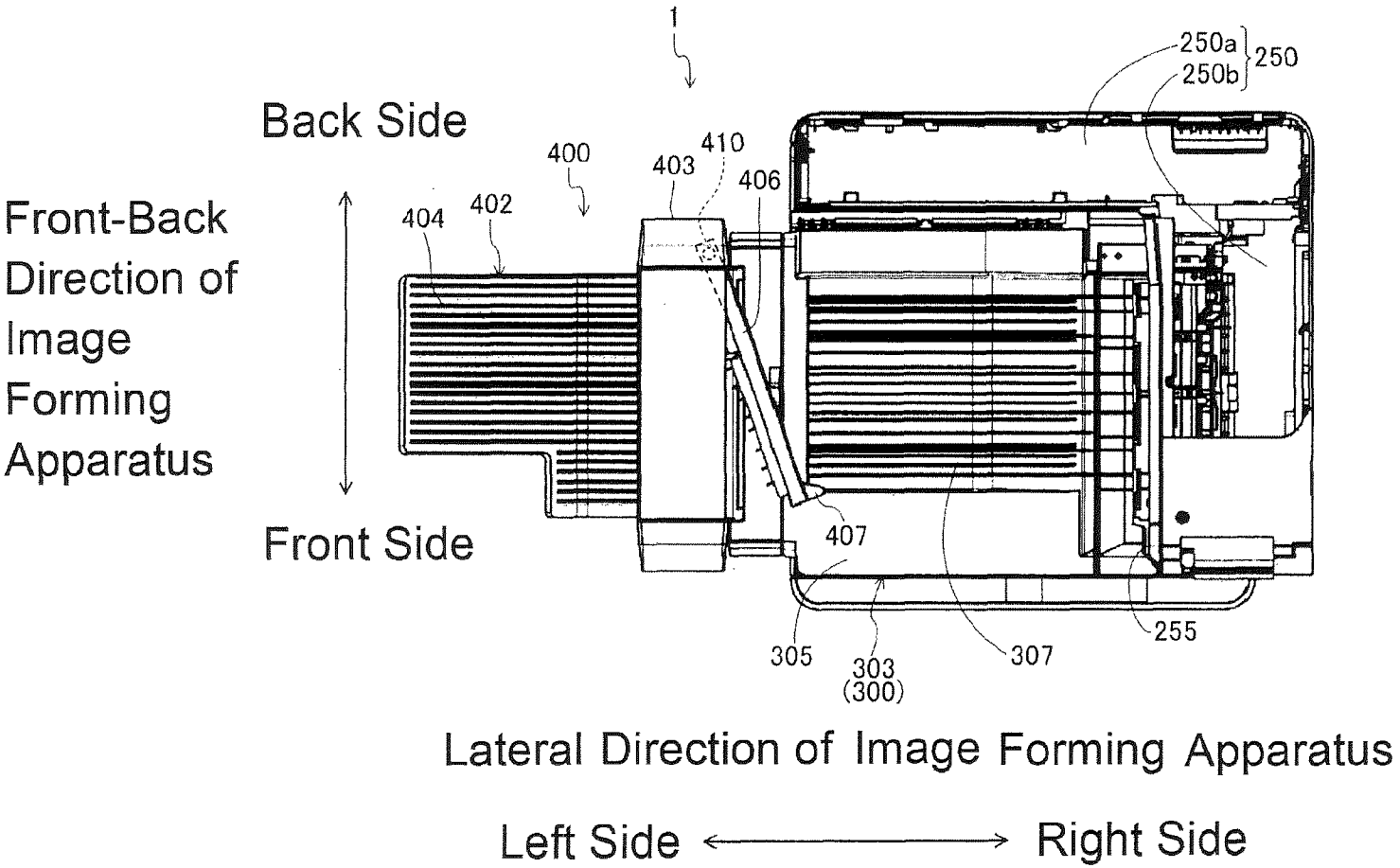
FIG. 4 illustrates a plan view of the image forming apparatus where the multi-tray cover is in the open state and the relay device cover is in the closed state according to Embodiment 1.

A case where the relay device cover 305 is opened while the multi-tray cover 406 is in the open state, will be examined with reference to FIG. 4. In this case, the relay device cover 305 bumps against the lower end portion of the multi-tray cover 406, which may cause damage to the multi-tray cover 406. In response to this situation, the configuration in the embodiment forms the inclined surface portion 408 in the lower end portion of the multi-tray cover 406 to prevent damage to the multi-tray cover 406.

In the embodiment, that is, the relay device cover 305 is opened upward while the multi-tray cover 406 is in the open state, which causes the edge portion of the multi-tray cover 406 side in the relay device cover 305 to bump against the inclined surface portion 408 formed in the lower end portion of the multi-tray cover 406. When further opening the relay device cover 305, component force in a direction to close the multi-tray cover 406 is produced in the inclined surface portion 408. Consequently, the multi-tray cover 406 is pushed to a closing side by the component force to avoid to the outer side of a turning range of the relay device cover 305. This can prevent the multi-tray cover 406 from bumping against the relay device cover 305 to be damaged.

In the embodiment, the chamfer amount C1 of the inclined surface portion 408 gradually increases from the far side toward the near side with respect to the pivotal axis X1 of the multi-tray cover 406.

This ensures that the force when attempting to open the relay device cover 305 can be smoothly transmitted to the multi-tray cover 406 with the inclined surface portion 408. When the relay device cover 305 bumps against the multi-tray cover 406, the component force produced in the inclined surface portion 408 can cause the multi-tray cover 406 to smoothly avoid to the outer side of the turning range of the relay device cover 305. This can even more securely prevent the multi-tray cover 406 from bumping against the relay device cover 305 to be damaged.

Additionally, in the embodiment, as the user releases the hand from the relay device cover 305 that is in the open state, the relay device cover 305 turns downward under its own weight around the axis extending in the horizontal direction to return to be in the closed state.

This can proactively prevent the multi-tray cover 406 from being opened while this relay device cover 305 is in the open state. As a result, this configuration can prevent the multi-tray cover 406 from bumping against the relay device cover 305 to be damaged.

Embodiment 2

Figure 7:
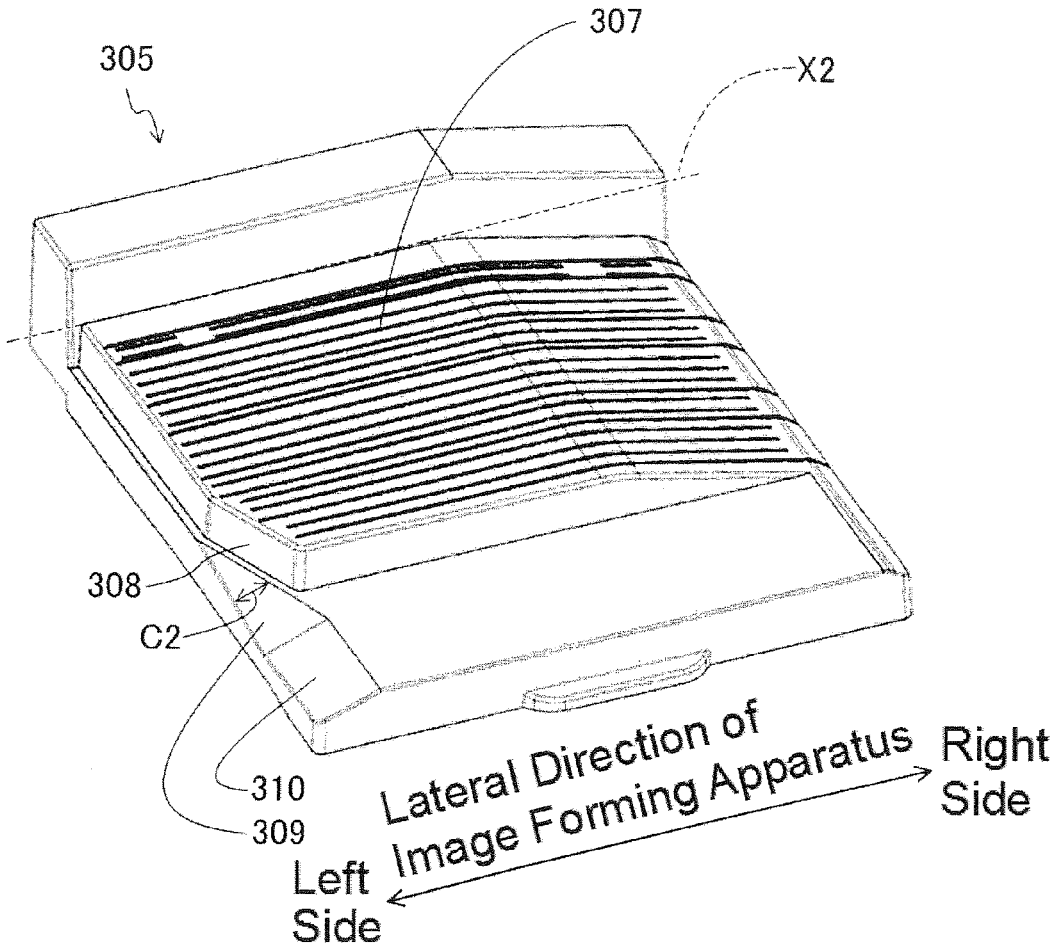
FIG. 7 diagonally illustrates a relay device cover of an image forming apparatus according to Embodiment 2.

FIG. 7 illustrates the relay device cover 305 of the image forming apparatus 1 according to Embodiment 2. Embodiment 2 differs from Embodiment 1 described above in that Embodiment 2 does not form the inclined surface portion 408 in the multi-tray cover 406 but forms an inclined surface portion (hereinafter referred to as a first inclined surface portion) 309 in the relay device cover 305.

The above-described first inclined surface portion 309 forms the shape, of which the edge portion of the multi-tray cover 406 side in a top surface portion of the relay device cover 305 is approximately chamfered. The first inclined surface portion 309 has an inclination angle in the lateral direction, which remains constant along this edge portion. The first inclined surface portion 309 further inclines at a constant inclination angle in the front and back direction and has a chamfer amount C2, which gradually decreases from the far side toward the near side with respect to a pivotal axis X2 in the relay device cover 305 (from the front side toward the back side). That is, the first inclined surface portion 309 is formed in a triangle shape that tapers down toward the back side viewed from the upper side. The first inclined surface portion 309 is formed in the only range corresponding to an area of the multi-tray cover 406 passing, when viewed from the upper side. In the front side of the first inclined surface portion 309, a second inclined surface portion 310 is formed, which forms in a rectangular shape viewed from the upper side. The second inclined surface portion 310 is formed in the outer side of the area of the multi-tray cover 406 passing, when viewed from the upper side. Therefore, the second inclined surface portion 310 is not always required.

The sheet discharge tray portion 307 includes a sidewall surface 308 that is adjacent to the first inclined surface portion 309 and inclines to the right side facing the front side. When the opening angle of the multi-tray cover 406 reaches the maximum opening angle, the sidewall surface 308 comes in contact with the outer surface of the multi-tray cover 406. Thus, the sidewall surface 308 keeps the opening angle of the multi-tray cover 406 to the maximum opening angle or less.

In the embodiment, when the relay device cover 305 is opened while the multi-tray cover 406 is in the open state as illustrated in FIG. 4, the first inclined surface portion 309 formed in the relay device cover 305 comes in contact with the lower end portion of the multi-tray cover 406. When further opening the relay device cover 305, the component force in the direction to close the multi-tray cover 406 is produced with the first inclined surface portion 309. Consequently, the multi-tray cover 406 is pushed to the closing side by the component force to avoid to the outer side of the turning range of the relay device cover 305. Similarly to Embodiment 1, this can prevent the multi-tray cover 406 from bumping against the relay device cover 305 to be damaged.

In the embodiment, the first inclined surface portion 309 gradually decreases from the far side toward the near side with respect to the pivotal axis X2 in the relay device cover 305 (from the front side toward the back side).

This ensures that the force when attempting to open the relay device cover 305 can be smoothly transmitted to the multi-tray cover 406 with the first inclined surface portion 309. When the relay device cover 305 bumps against the multi-tray cover 406, the component force produced from the first inclined surface portion 309 can cause the multi-tray cover 406 to smoothly avoid to the outer side of the turning range of the relay device cover 305. Therefore, similarly to Embodiment 1, this can even more securely prevent the multi-tray cover 406 from bumping against the relay device cover 305 to be damaged.

Other Embodiments

According to the embodiments described above, the description has been given of the example where the image forming apparatus 1 is the copier. However, it is not limited to the above, and the image forming apparatus 1 may be, for example, a printer, a multi-functional peripheral or similar device.

In Embodiment 1, the description has been given of the image forming apparatus 1 of the in-barrel paper sheet discharge type as the example. This, however, should not be construed in a limiting sense. That is, for example, the scanner housing portion 200 may be omitted, and alternatively, the image forming apparatus body 100 may have the upper side that is exposed to the outside.

As described above, the disclosure is useful for an image forming apparatus.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

an image forming apparatus body;

a multi-tray device including a plurality of sheet discharge trays located in a vertical direction, the multi-tray device being mounted on a side surface of the image forming apparatus body; and a relay device disposed over the image forming apparatus body, the relay device conveying a paper sheet discharged from the image forming apparatus body to the multi-tray device, wherein the multi-tray device includes a multi-tray cover that turns around an axis extending in the vertical direction as a pivot to openably and closably cover a side of the relay device of the multi-tray device, the relay device includes a relay device cover that turns around an axis extending in a horizontal direction as the pivot to openably and closably cover a top side of the relay device, one of an edge portion at a side of the relay device in a lower end portion of the multi-tray cover and an edge portion at a side of the multi-tray device in a top surface portion of the relay device cover includes an inclined surface portion forming a shape by chamfering the edge portion, and the inclined surface portion is formed so as to produce a component force in a direction to close the multi-tray cover when the top surface portion of the relay device cover bumps against the lower end portion of the multi-tray cover, while the relay device cover opens in a state where the multi-tray cover is opened.

2. The image forming apparatus according to claim 1, wherein the inclined surface portion is formed in the edge portion of the relay device side in the lower end portion of the multi-tray cover, and a chamfer amount of the inclined surface portion increases from a far side toward a near side with respect to a pivotal axis of the multi-tray cover.

3. The image forming apparatus according to claim 1, wherein the inclined surface portion is formed in the edge portion of the multi-tray device side in the top surface portion of the relay device cover, and a chamfer amount of the inclined surface portion decrease from a far side toward a near side with respect to the pivotal axis of the relay device cover.

4. The image forming apparatus according to claim 1, wherein when releasing the relay device cover while opening, the relay device cover turns downward under a weight of the relay device cover around the axis extending in the horizontal direction so as to be closed.

* * * * *